US006843194B1

(12) United States Patent
Baudet

(10) Patent No.: US 6,843,194 B1
(45) Date of Patent: Jan. 18, 2005

(54) SAIL WITH REINFORCEMENT STITCHING AND METHOD FOR MAKING

(76) Inventor: Jean-Pierre Baudet, Quartier de la Violette 4, Lausanne (CH), CH-1018

( * ) Notice: Subject to any disclaimer, the term of this patent is extended or adjusted under 35 U.S.C. 154(b) by 0 days.

(21) Appl. No.: 10/680,450

(22) Filed: Oct. 7, 2003

(51) Int. Cl.[7] ..... B63H 9/04
(52) U.S. Cl. ..... 114/102.29; 428/110
(58) Field of Search ..... 114/102.29

(56) References Cited

U.S. PATENT DOCUMENTS

| | | | | |
|---|---|---|---|---|
| 94,400 | A | 8/1869 | Crandall | |
| 3,954,076 | A * | 5/1976 | Fracker | 114/102.33 |
| 4,476,799 | A | 10/1984 | Bandy | |
| 4,593,639 | A | 6/1986 | Conrad | |
| 4,624,205 | A | 11/1986 | Conrad | |
| 4,679,519 | A | 7/1987 | Linville | |
| 4,708,080 | A | 11/1987 | Conrad | |
| 4,831,953 | A | 5/1989 | Conrad | |
| 4,945,848 | A | 8/1990 | Linville | |
| 5,038,700 | A | 8/1991 | Conrad | |
| 5,097,784 | A | 3/1992 | Baudet | |
| 5,172,647 | A | 12/1992 | Towne | |
| 5,333,568 | A | 8/1994 | Meldner et al. | |
| 5,403,641 | A | 4/1995 | Linville | |
| 6,112,689 | A | 9/2000 | Baudet | |
| 6,260,497 | B1 * | 7/2001 | Keire | 114/102.29 |
| 6,265,047 | B1 | 7/2001 | Chapius et al. | |
| 6,302,044 | B1 | 10/2001 | Baudet | |
| 6,311,633 | B1 | 11/2001 | Keire | |
| 6,382,120 | B1 | 5/2002 | Keire | |
| 6,624,098 | B1 * | 9/2003 | Mahr | 442/208 |

FOREIGN PATENT DOCUMENTS

EP 0 224 729 A1 6/1987

OTHER PUBLICATIONS

"Sailcloth the power in the rig," Yachts and Yachting, pp. 33–39 (Apr. 12, 1991).

* cited by examiner

*Primary Examiner*—Jesus D. Sotelo
(74) *Attorney, Agent, or Firm*—James F. Hann; Haynes Beffel & Wolfeld LLP

(57) ABSTRACT

A sail body comprises sail body material with reinforcement stitching along expected load lines. Optionally, the sail body may be a molded, three-dimensional sail body. At least half of the reinforcement stitching may extend along at least half of the lengths of the expected load lines. The reinforcement stitching may also comprise a combination of stretch-resistant and controlled-stretch stitching styles, the combination of stitching styles may further comprise a length of stretch-resistant stitching followed by or preceded by a length of controlled-stretch stitching. Optionally, the sail body material may be molded to create a three-dimensional, molded sail body. The molding step may be carried out before the reinforcement stitching is applied to the sail body material.

55 Claims, 3 Drawing Sheets

SAIL WITH REINFORCEMENT STITCHING AND METHOD FOR MAKING

CROSS-REFERENCE TO OTHER APPLICATIONS

None.

FEDERALLY SPONSORED RESEARCH OR DEVELOPMENT

None.

BACKGROUND OF THE INVENTION

The present invention is directed to the field of sails and methods for their manufacture.

Sails can be flat, two-dimensional sails or three-dimensional sails. Most typically, three-dimensional sails are made by broadseaming a number of panels. The panels, each being a finished sector of sailcloth, are cut along a curve and assembled to other panels to create the three-dimensional aspect for the sail. Traditionally sails have been made out of panels of sailcloth seamed together. Seams are narrow overlaps between panels; they can be stitched, bonded or both. The widths of the overlaps vary accordingly with the design strength of the sail. Typically wider seams are used on more highly loaded sails. The seams are generally aligned with the warp axis of the sailcloth. The seams generally cross the load direction when making cross cut-sails and are generally parallel to the load direction when making radial and tri-radial sails. The panels typically have a quadrilateral or triangular shape with a maximum width being limited traditionally by the width of the roll of finished sailcloth from which they are being cut. Typically the widths of the sailcloth rolls range between about 91.5 and 137 centimeters (36 and 58 inches).

Sailcloth manufacturers have developed low stretch rolls of sailcloth whether woven, non-woven or laminated to help control sail shape. In some woven materials made by Dirnension-Polyant of Germany, larger warp yarns or fill yarns or a combination of both might be combined with finer weave yarns to increase fabric strength.

Sailmakers have tried to take advantage of seam width to enhance the stability of the sail. For instance, U.S. Pat. No. 94,400, issued in 1869 to Crandall, shows the use of radiating seams out of the clews to bear strain and improve the set of the sail. During the 1970's while building cross-cut woven sails, Hood sailmakers typically used ½ width panels to increase the number of seams and therefore the percentage of overlap throughout the body of the sail. Later and since the 1980's sailmakers building tirradial sails aligned the seams tangent with the loads to increase stability of the sail. One of the benefit was to be able to reduce somewhat the weight of the sailfabric used compared to cross-cut constructions.

Sailmakers have many restraints and conditions placed on them. In addition to building products which will resist deterioration from weather and chafe abuses, a goal of modern sailmaking is to create a lightweight, flexible, three-dimensional air foil that will maintain its desired aerodynamic shape through a chosen wind range. A key factor in achieving this goal is stretch control of the airfoil. Stretch is to be avoided for two main reasons. First, it distorts the sail shape as the wind increases, making the sail deeper and moving the draft aft. This creates undesired drag as well as excessive heeling of the boat. Second, sail stretch wastes precious wind energy that should be transferred to the sailcraft through its rigging.

Over the years, sailmakers have attempted to control stretch and the resulting undesired distortion of the sail in several additional ways.

One way sailmakers attempted to control sail stretch is by using low-stretch high modulus yarns in the making of the sailcloth. The specific tensile modulus in gr/denier is about 30 for cotton yarns (used in the 1940's), about 100 for Dacron® polyester yarns from DuPont(used in the 1950's to 1970's), about 900 for Kevlar ® para-aramid yarns from DuPont (used in 1980's) and about 3000 for carbon yarns (used in 1990's).

Another way sailmakers have attempted to control sail stretch has involved better yarn alignment based on better understanding of stress distribution in the finished sail. Lighter and yet lower-stretch sails have been made by optimizing sailcloth weight and strength and working on yarn alignment to match more accurately the encountered stress intensities and their directions. The efforts have included both fill-oriented and warp-oriented sailcloths and individual yarns sandwiched between two films.

An approach to control sail-stretch has been to build a more traditional sail out of conventional woven fill-oriented sailcloth panels and to reinforce it externally by applying flat tapes on top of the panels following the anticipated load lines. See U.S. Pat. Nos. 4,593,639 and 5,172,647. While this approach is relatively inexpensive, it has its own drawbacks. The reinforcing tapes can shrink faster than the sailcloth between the tapes resulting in severe shape irregularities. The unsupported sailcloth between the tapes often bulges, affecting the design of the airfoil. Also, when the normally straight tapes are applied along curved load lines, the radially inside yarns are placed in compression while the radially outside yarns are placed in tension so that the radially outside yarns support most of the load thus reducing the efficiency of the reinforcement tapes.

A further approach has been to manufacture narrow cross-cut panels of sailcloth having individual laid-up yarns following the load lines. The individual yarns are sandwiched between two films and are continuous within each panel. See U.S. Pat. No. 4,708,080 to Conrad. Because the individual radiating yarns are continuous within each panel, there is a fixed relationship between yarn trajectories and the yarn densities achieved. This makes it difficult to optimize yarn densities within each panel. Due to the limited width of the panels, the problem of having a large number of horizontal seams is inherent to this cross-cut approach. The narrow cross-cut panels of sailcloth made from individual spaced-apart radiating yarns are difficult to seam successfully; the stitching does not hold on the individual yarns. Even when the seams are secured together by adhesive to minimize the stitching, the proximity of horizontal seams to the highly loaded corners can be a source of seam, and thus sail, failure.

A still further approach has been to manufacture simultaneously the sailcloth and the sail in one piece (membrane) on a convex mold using uninterrupted load-bearing yarns laminated between two films, the yarns following the anticipated load lines. See U.S. Pat. No. 5,097,784 to Baudet. While providing very light and low-stretch sails, this method has its own technical and economic drawbacks. The uninterrupted nature of every yarn makes it difficult to optimize yarn densities, especially at the sail corners. Also, the specialized nature of the equipment needed for each individual sail makes this a somewhat capital-intensive and thus expensive way to manufacture sails.

Another way sail makers have controlled stretch and maintained proper sail shape has been to reduce the crimp or geometrical stretch of the yarn used in the sailcloths. Crimp is usually considered to be due to a serpentine path taken by a yarn in the sailcloth. In a weave, for instance, the fill and warp yarns are going up and down around each other. This prevents them from being straight and thus from initially fully resisting stretching. When the woven sailcloth is loaded, the yarns tend to straighten before they can begin resist stretching based on their tensile strength and resistance to elongation. Crimp therefore delays and reduces the stretch resistance of the yarns at the time of the loading of the sailcloth.

In an effort to eliminate the problems of this "weave-crimp", much work has been done to depart from using woven sailcloths. In most cases, woven sailcloths have been replaced by composite sailcloths, typically made up from individual laid-up (non-woven) load-bearing yarns sandwiched between two films of Mylar® polyester film from DuPont or some other suitable film. There are a number of patents in this area, such as Sparkman EP 0 224 729, Linville U.S. Pat. No. 4,679,519, Conrad U.S. Pat. No. 4,708,080, Linville U.S. Pat. No. 4,945,848, Baudet U.S. Pat. No. 5,097,784, Meldner U.S. Pat. No. 5,333,568, and Linville U.S. Pat. No. 5,403,641.

See U.S. Pat. Nos. 6,265,047 and 6,302,044.

SUMMARY OF THE INVENTION

The present invention is directed to a sail body of a type having expected load lines. The sail body comprises sail body material having a circumferential edge and at least one seamless region. The sail body also has reinforcement stitching, comprising reinforcement stitching thread, along expected load lines within the seamless region. Optionally, the sail body may be a molded, three-dimensional sail body. At least half of the reinforcement stitching may extend along at least half of the lengths of the expected load lines. The reinforcement stitching may also comprise a combination of stretch-resistant and controlled-stretch stitching styles, the combination of stitching styles may further comprise a length of stretch-resistant stitching followed by or preceded by a length of controlled-stretch stitching.

A further aspect of the invention is directed to a method for making a sail body of a type having expected load lines. A sail body material, comprising a circumferential edge and at least one seamless region, is chosen. Reinforcement stitching, comprising reinforcement stitching thread, is applied along expected load lines within the seamless region. Optionally, the sail body material may be molded to create a three-dimensional, molded sail body. The molding step may be carried out before or after the reinforcement stitching applying step. A combination of stretch-resistant and controlled-stretch stitching styles of reinforcement stitching may be selected. It may be desired to extend at least half of the reinforcement stitching along at least half of the lengths of the expected load lines. It may also be desired to create a length of reinforcement stitching comprising a length of stretch-resistant stitching followed by or preceded by a length of controlled-stretch stitching.

One aspect of the invention that should be emphasized is that the reinforcement stitching differs from stitches used in traditional seam-assembled sails. The purpose of the reinforcement stitching is not to seam and assemble sail panels together. The present reinforcement stitching purpose is to reinforce the sail fabric in directions following the anticipated sail load. This permits a variation in stitch density per sail area to provide the sailcloth with a variation of stretch resistance characteristic throughout the body of the sail that wouldn't be possible with, for example, conventional two axis sailcloth construction.

One of the advantages, especially for smaller boats, of the invention is that due to the increased strength provided by the reinforcement stitching, the weight of the sail can be reduced because the weight of the sail body material can be reduced over what would be needed for a conventional sail. Another advantage of the invention is that the resulting improved performance characteristics might allow for improved performance over a wider wind-range, which might be very desirable in boat classes where the sail inventory is limited by the class rules.

Other features and advantages of the invention will appear from the following description in which the preferred embodiments have been set forth in detail in conjunction with the accompanying drawings.

DETAILED DESCRIPTION OF THE INVENTION

Figure 3:
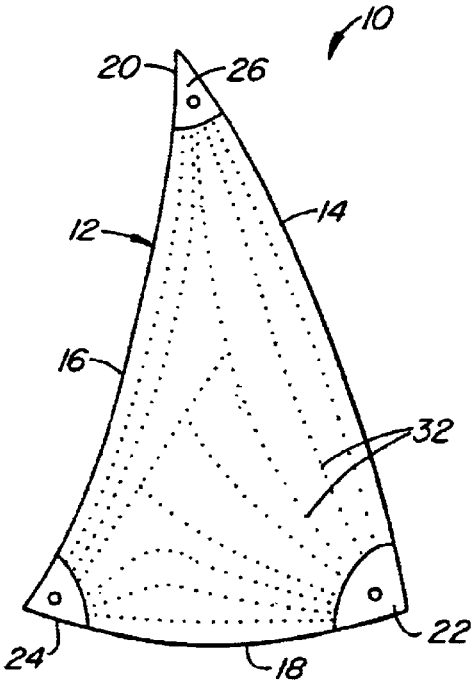
FIG. 3 is a plan view of a sail made according to the invention including the reinforcement stitching of FIG. 2 and corner patches at the corners.

FIG. 3 illustrates a sail 10 made according to the invention. In this embodiment sail 10 includes a sail body 12 and has three edges, luff 14, leech 16 and foot 18. Sail 10 also has three corners, head 20 at the top, tack 22 at the lower forward corner of the sail at the intersection of luff 14 and foot 18, and clew 24 a the lower aft corner of the sail at the intersection of the leech and the foot. While sail 10 is typically a molded, generally triangular, three-dimensional sail, it could also be a two-dimensional sail and could have any of a variety of shapes. The finished sail 10 includes corner patches 26 at head 20, tack 22 and clew 24 and luff-tape along luff 14, leech-tape along leech 16 and foot-tape along foot 18 to create the finished sail.

Figure 1:
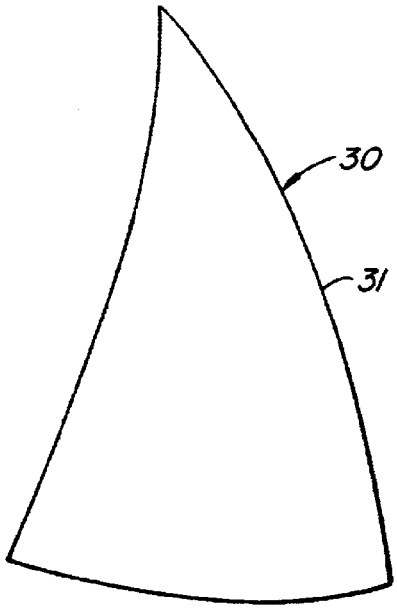
FIG. 1 is a plan view of a one-piece sail body material.
Figure 2:
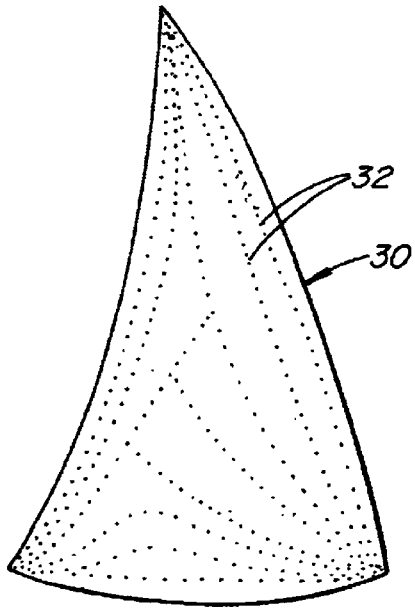
FIG. 2 is a view of the sail body material of FIG. 1 with reinforcement stitching along expected load lines.

FIG. 1 illustrates one piece sail body material 30, having a circumferential edge 31, from which the sail body 12 is constructed. FIG. 2 illustrates sail body material 30 with reinforcement stitching 32 along expected load lines. Reinforcement stitching 32 is intended to provide additional strength to sail 10 where it is needed, that is, along the expected load lines. The expected load lines may change depending upon, for example, operating conditions.

Figure 4:
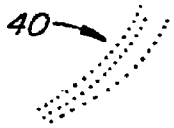
FIG. 4 illustrates straight, continuous stitching
Figure 7:
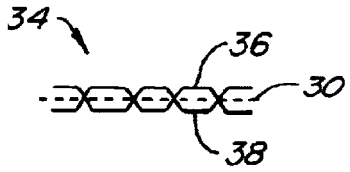
FIG. 7 is a simplified, expanded cross sectional view illustrating the arrangement of the threads of a lock stitch.

Typically reinforcement stitching 32 is a stretch-resistant stitching style, such as the straight, continuous stitching 40 as illustrated in FIG. 4. FIG. 7 illustrates a vertically-expanded cross sectional view of a typical lock stitch 34 illustrating the passage of the threads 36, 38 along alternating sides of sail body material 30. The use of reinforcement stitching 32 provides a generally simple means for increasing the strength of sail body 12 without the need for using the relatively complicated conventional sail construction techniques. The reinforcement stitching 32 of sail 10 (see FIGS. 3 and 10), being along expected load lines for a chosen use condition, can create a sail having constant strain characteristics under the chosen use condition.

The tensile strength of sail body 12 along the expected load lines may be adjusted or modified by adjusting or selecting the appropriate tensile strength for thread 36, 38 of reinforcement stitching 32. The lateral spacing or density of reinforcement stitching 32 may also be changed to adjust the tensile strength of sail body 12 along the expected load lines. Thread 36, 38 may be monofilament or multi-filament and may be made of, for example, natural fibers, artificial fibers, metal fibers or a suitable combination thereof. Thread 36, 38 is typically a high strength, durable material such as nylon, carbon fiber, polyester, Spectra® gel spun polyethylene from Allied Signal Corporation or Kevlar® para-aramid fiber from DuPont.

Figure 5:
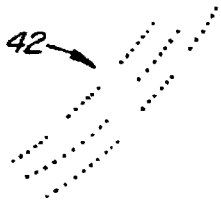
FIG. 5 illustrates straight, discontinuous stitching.
Figure 6:
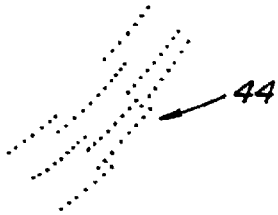
FIG. 6 illustrates straight, discontinuous, laterally-offset stitching.

FIG. 5 illustrates straight, discontinuous reinforcement stitching 42 along expected load lines. Straight, discontinuous, laterally-offset stitching 44 is illustrated in FIG. 6. Stitching 40, 42, 44 may be used in a variety of combinations to achieve the desired tensile strength. A with modest amount of controlled stretch at various portions of sail body 12 may be provided by stitching styles 42, 44, in particular straight, discontinuous stitching 42.

Figure 8:
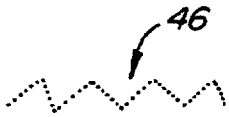
FIG. 8 illustrates a zigzag stitch.
Figure 9:
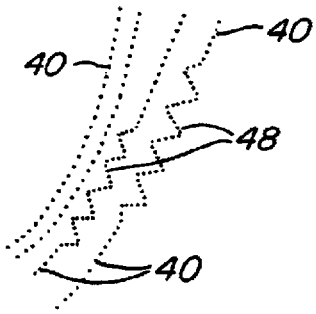
FIG. 9 illustrates lengths of straight, continuous stitching adjacent to sections of zigzag stitching along lengths of straight, continuous stitching.

In some situations it may be desirable not to use stretch-resistant stitching over all or part of sail body 12 but rather use one or more controlled-stretch stitching styles, such as zigzag stitching 46, see FIG. 8, alone or in conjunction with straight stitching 40. FIG. 9 illustrates sections 48 of zigzag stitching 46 interspersed along straight, continuous stitching 40. For example, it may be desired to use straight stitching 40 (or 42, 44) along the middle portion of leech 16 to increase stiffness along that portion and zigzag stitching 48 along other portions where it is desired that the sail be less stiff. This combination might be used to enhance the character of the leech twist, providing both pointing ability to the boat and a natural overflow of the upper leech in the puffs, that is when the wind velocity and/or direction changes rapidly.

Figure 10:
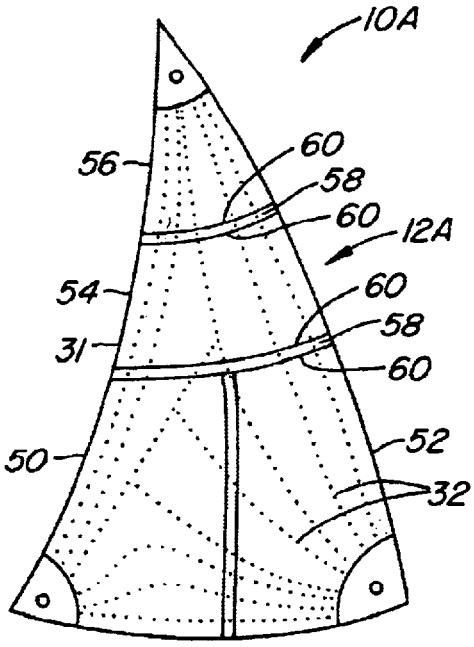
FIG. 10 is a view of an alternative embodiment of the invention in which the sail is made of several body sections to create several seamless regions.

FIG. 10 illustrates a sail 10A substantially similar to sail 10 of FIG. 3 but in which the sail body 12A is made of, in this example, four body sections 50, 52, 54, 56, each body section broad seamed together at seam regions 58 with the edges 60 of adjacent body sections overlapping. In this embodiment reinforcement stitching 32 is substantially similar to that shown in FIG. 3 with the reinforcement stitching passing over seam regions 58.

Figure 11:
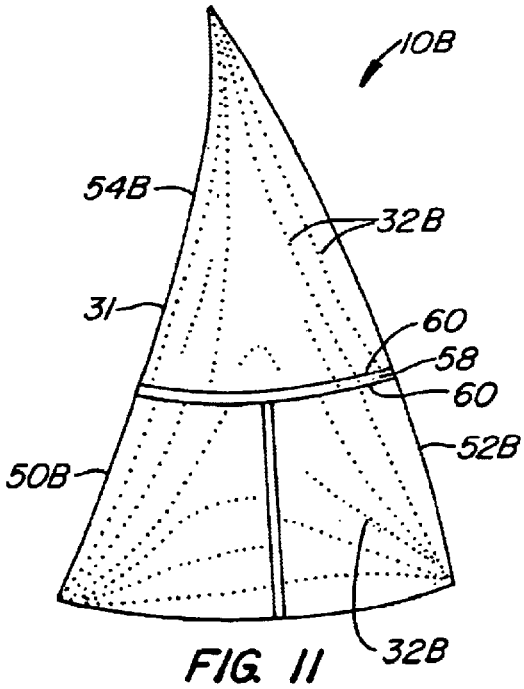
FIG. 11 is a further alternative embodiment similar to the embodiment of FIG. 10 but in which the reinforcement stitching of one seamless region does not necessarily connect with the reinforcement stitching of an adjacent seamless region.

FIG. 11 shows a sail 10 B similar to that of FIG. 10 but having two main differences. First, sail 10 B has only three body sections 50 B, 52 B, 54 B. Second, reinforcement stitching 32 B of one body section 50 B, 52 B 54 B is not necessarily aligned with or continuous with the reinforcement stitching 32 B of an adjacent body section. Also, it should also be noted that in the FIG. 11 embodiment, each length of reinforcement stitching 32 B does not necessarily extend to another length of reinforcement stitching, or to an edge of a body section 50 B, 52 B, 54 B, or between two positions along circumferential edge 31 B.

When sail 10, 10 A, or 10 B is a molded, three-dimensional sail, reinforcement stitching 32 may be made before or after sail body material 30 has been molded to a three-dimensional shape. It is expected that the preferred time for applying reinforcement stitching 32 will typically be after the molding process; this is especially true when using non thermoformable yarns in the reinforcement stitching. If, however, the sail material can relax sufficiently during a heated molding process, reinforcement stitching 32 may be made to sail body material 30 before the molding process because the non-thermoformable reinforcement stitching can adjust to the new shape.

If desired, a resin-type of protective material may be applied to reinforcement stitching 32 to protect the stitching against abrasive and other damage. Sail body material 30 may be made from various materials, such as woven sail cloth, polymer film, composite sail cloth, laminated material or an appropriate combination thereof. Butt scams or other types of seams may create some or all of seam regions 58. The invention may be used to create a variety of types of sails, including main sails, jibs and spinnakers.

Sail body material, when comprising a woven fabric, typically has warp and fill yarns oriented at right angles to another, as is conventional. Because the expected load lines do not follow such a regular orientation, the reinforcement stitching typically does not follow the path of the warp and fill yarns. Rather, the reinforcement stitching is largely, if not entirely, oriented at various angles to the warp and fill yarns.

During conventional lock stitch sewing, the upper thread is forced through the material, where it is engaged by the rotating shuttle hook of the bobbin assembly, and is pulled back up through the material. Assuming both threads are the same and under similar tension, the resulting stitch will be similar to that shown in FIG. 7 with each thread passing about halfway through material 30 with a crimp imparted to each thread.

Figure 12:
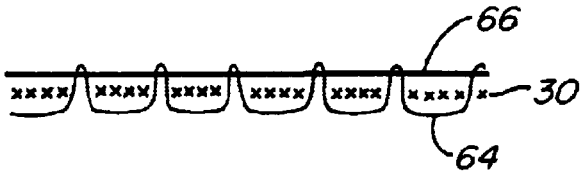
FIG. 12 is a cross sectional view similar to that of FIG. 7 in which the upper thread is a higher strength structural thread lying against one surface of the sail body material.

In some cases, and when any applicable class rules allow it, it might be preferred to mix a more structural yarn with a stitching thread. For instance a lower, bobbin thread 64, see FIG. 12, could be a conventional thread used for stitching, such as a light nylon or polyester thread. The tensioning of thread 64 would be relatively loose. An upper, structural thread 66 would be made from a higher strength, more structural fiber, such as a low stretch polyester, Pentex polyester from Honeywell, Spectra®, aramid, carbon, PBO, or others, typically ranging in sizes between 200 and 3000 deniers. Lower, bobbin thread 64 on the underside is relatively loose compared to the tension on structural threaded 66 so that after each stitch, the higher strength, higher tensioned structural thread 66 tends to resist stretching and tends to straighten out after each stitch so to reduce or eliminate crimp. The resulting structural thread 66 is generally straight, that is it lies generally parallel to and against a surface of sail body material 30 and no longer passes through material 30 as does bobbin thread 64. Structural thread 66 might be pre-coated with a flexible resin or the like to limit the risk of filament damage and excessive chafe.

Figure 13:
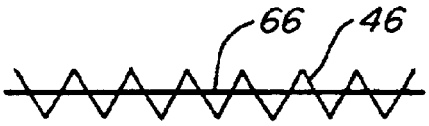
FIGS. 13 and 14 are plan and cross sectional views illustrating a zigzag stitch securing a structural thread against one surface of the sail body material.
Figure 14:
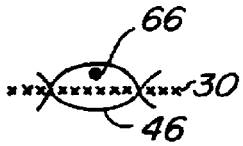
Figure 15:
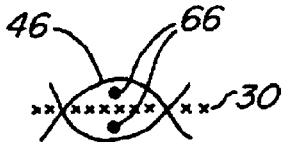
FIG. 15 is a view similar to that of FIG. 14 but illustrating a zigzag stitch securing a structural thread against each of the upper and lower surfaces of the sail body material.
Figure 16:
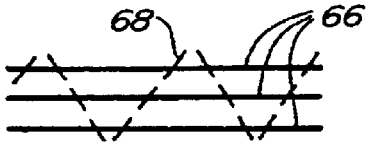
FIGS. 16 and 17 are plan and cross sectional views illustrating a three-step zigzag stitch securing three structural threads against one surface of the sail body material.
Figure 17:
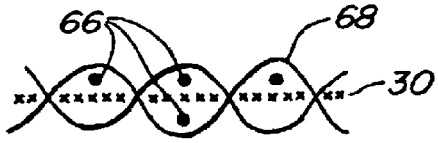

In other cases, structural thread 66 may be combined with conventional zigzag stitches 46. See FIGS. 13 and 14. A spool of structural thread 66 may be placed behind the sewing machine and thread 66 would be then held in place between zigzag stitches 46. This would limit crimp (geometrical stretch) of structural thread 66 while being a bit more friendly process for the structural filaments than forcing them up and down in through sail body material 30. Along the same line of thought, a second structural yarn, see FIG. 15, could be added to the lower side of the sail fabric using the underneath side of the same zigzag stitch. When using multiple-step zigzag stitching, such as the three-step zigzag stitching 68 shown in FIGS. 16 and 17, multiple structural threads 66 could be added on one or both sides. Here again the structural threads could be pre-coated with a flexile polyester resin or the like to limit the risk of filament damage and excessive chafe.

Figure 18:
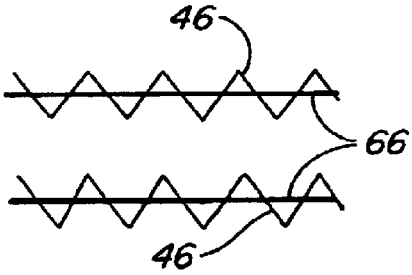
FIGS. 18 and 19 are plan and cross sectional views illustrating tandem zigzag stitching securing two structural threads against one surface of the sail body material.
Figure 19:
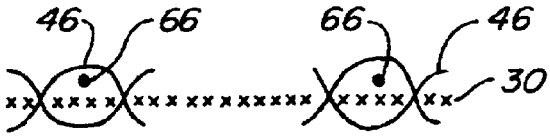

Some sewing machines can simultaneously lay down two equidistant stitches next to each other and therefore follow any of the above approach in tandem or in combination. For example, FIGS. 18 and 19 illustrate tandem zigzag stitches 46 capturing structural threads 66.

Multiple stranded threads, such as shown in FIGS. 16–19, may follow straight or curved paths. One advantage over the use of flat reinforcement tapes applied on the top of the sail body material when following a curved path, is that the radially inside structural threads are not placed in compression and the radially outside the structural threads are not placed in tension as occurs with conventional flat tapes.

Modification and variation can be made to the disclosed embodiments without departing from the subject of the invention defined by the following claims. For example, structural thread 66 may be pre-coated or post-coated with an adhesive to help maintain the desired intimate stress transferring relationship between the reinforcement stitching and the sail body material. Such adhesive may also be heat or otherwise activated.

Any and all patents, patent applications and printed publications referred to above are incorporated by reference.

What is claimed is:

1. A sail body, of a type having expected load lines, comprising:

sail body material comprising a circumferential edge and at least one seamless region; and reinforcement stitching, comprising reinforcement stitching thread, along expected load lines within the seamless region.

2. The sail body according to claim 1 wherein the sail body material comprises a seamless, one-piece sail body material.

3. The sail body according to claim 1 wherein the sail body material comprises a plurality of seamless regions, the seamless regions comprising adjacent edges, the seamless regions joined at seams along the adjacent edges to create seam regions.

4. The sail body according to claim 3 further comprising seam reinforcement stitching within the seam regions.

5. The sail body according to claim 1 wherein at least some of the reinforcement stitching extends continuously from one position along the circumferential edge to another position along the circumferential edge.

6. The sail body according to claim 1 wherein at least some of the reinforcement stitching extends only partway along an expected load line.

7. The sail body according to claim 1 wherein at least half of the reinforcement stitching extends along at least half of the lengths of the expected load lines.

8. The sail body according to claim 1 wherein the reinforcement stitching comprises a stretch-resistant stitching style.

9. The sail body according to claim 8 wherein the stretch-resistant stitching style comprises straight stitching.

10. The sail body according to claim 1 wherein the reinforcement stitching comprises a combination of stretch-resistant and controlled-stretch stitching styles.

11. The sail body according to claim 10 wherein the combination of stretch-resistant and controlled-stretch stitching styles comprises straight stitching and zigzag stitching.

12. The sail body according to claim 10 wherein the combination of stretch-resistant and controlled-stretch stitching styles comprises a length of stretch-resistant stitching followed by or preceded by a length of controlled-stretch stitching.

13. The sail body according to claim 1 wherein the sail body is a molded sail body.

14. The sail body according to claim 1 further comprising a material covering at least some of the reinforcement stitching.

15. The sail body according to claim 14 wherein the material comprises a resin-type of material used to help protect the reinforcement stitching.

16. The sail body according to claim 1 wherein the sail body material comprises a laminated sail body material.

17. The sail body according to claim 16 wherein the entire sail body material is laminated.

18. The sail body according to claim 1 further comprising means for adjusting the tensile strength of the sail body along expected load lines.

19. The sail body according to claim 1 wherein the sail body material comprises first and second surfaces and the reinforcement stitching comprises a higher strength structural thread and a lower strength positioning thread.

20. The sail body according to claim 19 wherein the structural thread lies generally against the first surface of the sail body material and the positioning thread passes through the sail body material.

21. The sail body according to claim 19 wherein the reinforcement stitching comprises first and second structural threads.

22. The sail body according to claim 21 wherein the first and second structural threads lie against the first and second surfaces of the body material respectively.

23. The sail body according to claim 19 wherein the positioning thread comprises zigzag stitching.

24. The sail body according to claim 19 wherein the positioning thread comprises multiple-step zigzag stitching.

25. The sail body according to claim 24 wherein the reinforcement stitching comprises first and second structural threads both lying against the first surface of the body material.

26. A three-dimensional, molded sail body, of a type having expected load lines, comprising:

molded sail body material comprising a circumferential edge and at least one seamless region;

reinforcement stitching, comprising reinforcement stitching thread, along expected load lines within the seamless region;

at least half of the reinforcement stitching extending along at least half of the lengths of the expected load lines; and the reinforcement stitching comprising a combination of stretch-resistant and controlled-stretch stitching styles, the combination of stretch-resistant and controlled-stretch stitching styles comprising a length of stretch-resistant stitching followed by or preceded by a length of controlled-stretch stitching.

27. A method for making a sail body, of a type having expected load lines, comprising:

choosing a sail body material comprising a circumferential edge and at least one seamless region; and applying reinforcement stitching, comprising reinforcement stitching thread, along expected load lines within at least the seamless region of the sail body material.

28. The method according to claim 27 wherein the choosing step comprises choosing seamless, one-piece sail body material.

29. The method according to claim 27 wherein the choosing step comprises choosing sail body material with a plurality of seamless regions, the seamless regions comprising adjacent edges, the seamless regions joined at seams along the adjacent edges to create seam regions.

30. The method according to claim 29 wherein the choosing step comprises choosing sail body material with seam reinforcement stitching within the seam regions.

31. The method according to claim 27 wherein the reinforcement stitching applying step comprises extending at least some of the reinforcement stitching continuously from one position along the circumferential edge to another position along the circumferential edge.

32. The method according to claim 27 wherein the reinforcement stitching applying step comprises extending at least some of the reinforcement stitching only partway -along an expected load line.

33. The method according to claim 27 wherein the reinforcement stitching applying step comprises extending at least half of the reinforcement stitching along at least half of the lengths of the expected load lines.

34. The method according to claim 27 further comprising selecting a stretch-resistant stitching style for at least some of the of reinforcement stitching.

35. The method according to claim 34 wherein the stretch-resistant stitching style selecting step comprises selecting a straight stitching style of stretch-resistant stitching.

36. The method according to claim 27 further comprising selecting a combination of stretch-resistant and controlled-stretch stitching styles of reinforcement stitching.

37. The method according to claim 36 wherein the stitching styles the selecting step comprises selecting straight stitching and zigzag stitching styles.

38. The method according to claim 36 wherein the applying step comprises creating a length of reinforcement stitching comprising a length of stretch-resistant stitching followed by or preceded by a length of controlled-stretch stitching.

39. The method according to claim 27 further comprising molding a molded sail body from the body material.

40. The method according to claim 39 wherein the molding step is carried out before the reinforcement stitching applying step.

41. The method according to claim 27 further comprising covering at least some of the reinforcement stitching with a material.

42. The method according to claim 41 wherein the covering step is carried out using a resin-type of material to help protect the reinforcement stitching.

43. The method according to claim 27 wherein the body material choosing step comprises selecting a laminated sail body material.

44. The method according to claim 43 wherein the selecting step is carried out so that the entire sail body material is laminated.

45. The method according to claim 27 further comprising adjusting the tensile strength of the sail body along expected load lines.

46. The method according to claim 45 wherein the tensile strength adjusting step comprises adjusting the tensile strength of the reinforcement stitching thread.

47. The method according to claim 45 wherein the tensile strength adjusting step comprises adjusting the lateral spacing of the reinforcement stitching.

48. The method according to claim 27 wherein the applying step comprises applying a higher strength structural thread and a lower strength positioning thread as the reinforcement stitching.

49. The method according to claim 48 wherein the applying step comprises applying structural thread to lie generally against a first surface of the sail body material and applying the positioning thread to pass through the sail body material.

50. The method according to claim 48 wherein the applying step comprises applying comprises applying first and second structural threads.

51. The method according to claim 48 wherein the applying step comprises applying first and second structural threads to lie against the first surface and a second surface with of the body material respectively.

52. The method according to claim 48 wherein the applying step comprises applying zigzag positioning thread.

53. The method according to claim 48 wherein the applying step comprises applying multiple-step zigzag positioning thread.

54. The method according to claim 53 wherein the applying step comprises securing first and second structural threads against the first surface of the body material with the multiple-step zigzag positioning thread.

55. A method for making a three-dimensional, molded sail body, of a type having expected load lines, comprising:

choosing a sail body material comprising a circumferential edge and at least one seamless region;

molding a three-dimensional, molded sail body from the body material;

selecting a combination of stretch-resistant and controlled-stretch stitching styles of reinforcement stitching;

applying reinforcement stitching, comprising reinforcement stitching thread, along expected load lines within the seamless region;

the reinforcement stitching applying step comprising;

extending at least half of the reinforcement stitching along at least half of the lengths of the expected load lines; and creating a length of reinforcement stitching comprising a length of stretch-resistant stitching followed by or preceded by a length of controlled-stretch stitching; and the molding step being carried out before the reinforcement stitching applying step.

* * * * *